US008051523B1

(12) United States Patent
Franzino

(10) Patent No.: US 8,051,523 B1
(45) Date of Patent: Nov. 8, 2011

(54) TUBE CLEANING IMPLEMENT

(75) Inventor: Joseph J Franzino, Redding, CT (US)

(73) Assignee: Goodway Technologies Corporation, Stamford, CT (US)

( * ) Notice: Subject to any disclaimer, the term of this patent is extended or adjusted under 35 U.S.C. 154(b) by 0 days.

(21) Appl. No.: 11/529,171

(22) Filed: Sep. 28, 2006

(51) Int. Cl.
*B08B 9/04* (2006.01)

(52) U.S. Cl. ..... 15/104.061; 15/104.05; 15/104.2

(58) Field of Classification Search ..... 15/104.61, 15/104.5, 104.2
See application file for complete search history.

(56) References Cited

U.S. PATENT DOCUMENTS

| | | | | |
|---|---|---|---|---|
| 3,319,710 | A * | 5/1967 | Heeren et al. | 165/95 |
| 3,939,519 | A * | 2/1976 | Muirhead | 15/104.061 |
| 4,069,535 | A * | 1/1978 | Cato | 15/104.061 |
| 4,124,065 | A * | 11/1978 | Leitner et al. | 165/95 |
| 4,643,248 | A * | 2/1987 | Voith et al. | 165/95 |
| 5,400,456 | A * | 3/1995 | Skibowski | 15/104.061 |
| 5,600,863 | A * | 2/1997 | Curran | 15/104.061 |
| 6,085,376 | A * | 7/2000 | Antal et al. | 15/104.061 |
| 6,145,150 | A * | 11/2000 | Knapp | 15/104.061 |
| 6,553,602 | B1 * | 4/2003 | Skarupa et al. | 15/104.061 |
| 6,574,821 | B1 * | 6/2003 | Dal Maso et al. | 15/104.061 |

* cited by examiner

*Primary Examiner* — Dung Van Nguyen
(74) *Attorney, Agent, or Firm* — Patrick J. Walsh

(57) ABSTRACT

A tube cleaning implement with elongate shaft supporting a brush in a median section and similar scrapers or wipers fitted to opposite ends of the shaft to provide for a scrape-brush-scrape cleaning action of tube interiors, and to provide a reversible implement having extended useful life.

5 Claims, 1 Drawing Sheet

TUBE CLEANING IMPLEMENT

BACKGROUND OF THE INVENTION

This invention relates to tube cleaning and particularly to cleaning condenser tubes utilizing a fluid propelled cleaning implement for removing deposits and dirt from the interior surface of condenser tubes as well as other power plant equipment fitted with tubes.

In normal operation, hard deposits such as rust and scale containing calcium, and soft deposits including slime and loose dirt build up on the interior surface of heat exchanger tubes that diminishes thermal efficiency and restricts fluid flow through the tubes. To maintain thermal efficiency and design flow in operation of the heat exchanger, it is necessary to remove such deposits.

These deposits are removed mechanically using a projectile driven through the tube by pressurized media including air, water, steam, or other gas. The pressure media propels the projectile through a tube. The projectile is fitted with scrapers engaging the tube interior wall for removing deposits as the projectile transits the tube. Preferably, the projectile pushes removed deposits ahead through the tube so both projectile and deposits are ejected from the far end of the tube.

The chief objective of the present invention is to provide an improved reversible tube cleaning implement with multiple wipers to pre-clean and post-clean for median bristles in removing deposits from the interior surface of heat exchanger tubes.

SUMMARY OF THE INVENTION

The present invention provides a tube cleaning implement having an elongate axial shaft with brush bristles extending radially from a central section of the shaft, and with a set of scrapers or wipers with multiple flat discs fitted to each end of the shaft. The implement performs a scrape-brush-scrape action on a tube wall as it is being propelled through the tube.

Multiple wipers on both ends pre-clean and post-clean a tube surface for the bristles. The wipers flat disc configuration renders the implement reversible so that it may be inserted at either of its ends into a tube. Reversibility extends the implement's useful life, especially useful life of the bristles.

Specific examples are included in the following description for purposes of clarity, but various details can be changed within the scope of the present invention.

OBJECTS OF THE INVENTION

An object of the invention is to provide an improved tube cleaning implement providing a scrape-brush-scrape cleaning action of a tube wall in a single pass of the implement through the tube.

Another object of the invention is to provide a robust tube cleaning implement having scraper discs at leading and following ends and a spiral wound steel brush between the scraper discs.

Another object of the invention is to provide a reversible tube cleaning implement that can be inserted into a tube by either of the implements to extend the useful life of the implement especially of the bristles.

Another object of the invention is to provide a reusable tube cleaning implement with multiple simultaneous cleaning action.

Other and further objects of the invention will become apparent with an understanding of the following detailed description of the invention or upon employment of the invention.

BRIEF DESCRIPTION OF THE DRAWING

A preferred embodiment of the invention has been chosen for detailed description to enable those having ordinary skill in the art to which the invention appertains to readily understand how to construct and use the invention and is shown in the accompanying drawing in which.

DETAILED DESCRIPTION OF THE PREFERRED EMBODIMENT

Figure 1:
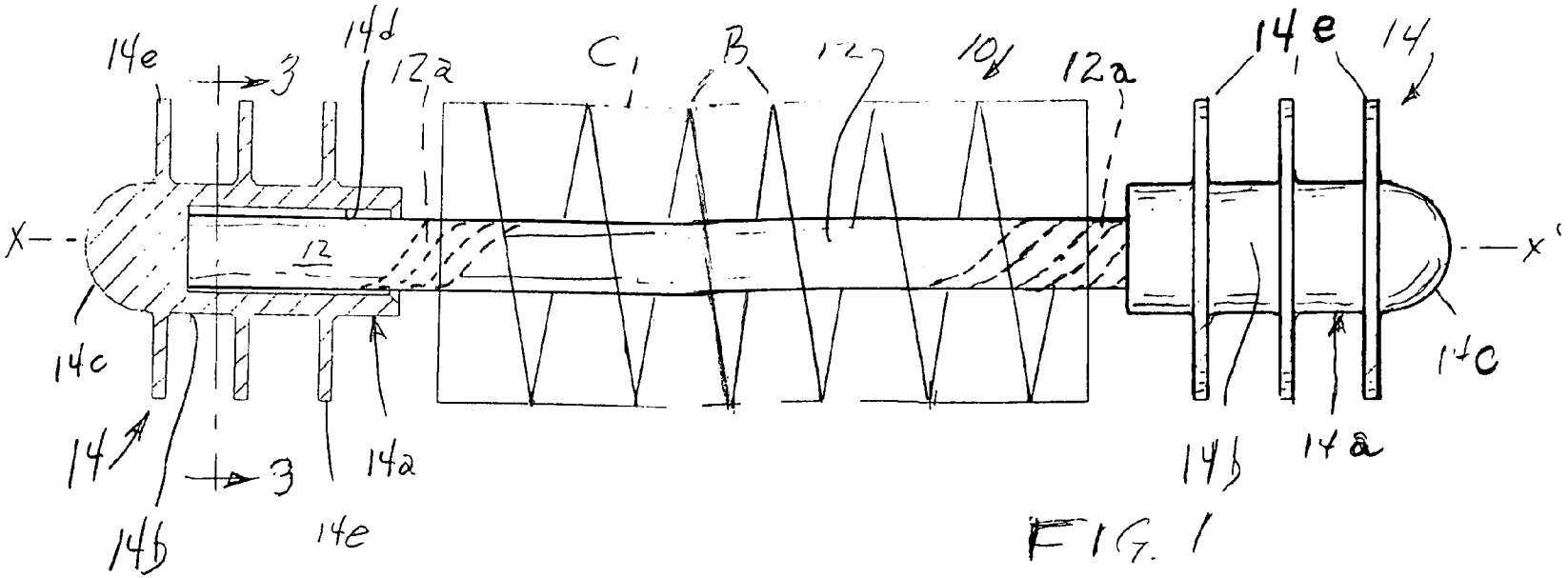
FIG. 1 is a schematic plan view partially in section of a tube cleaning implement according to the invention.
Figure 3:
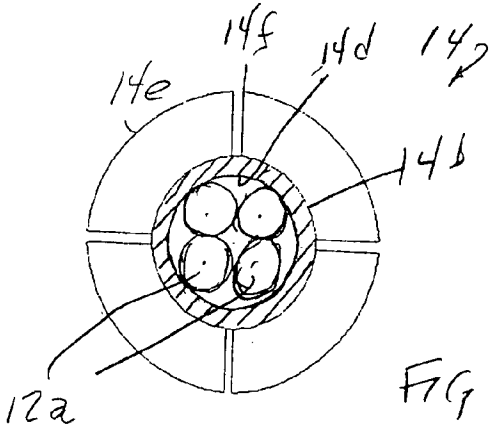
FIG. 3 is a section view taken along line 3-3 of FIG. 3.
Figure 2:
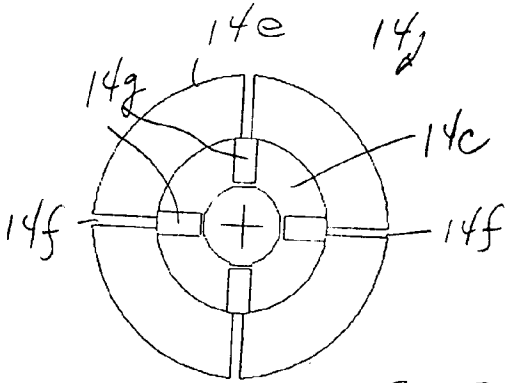
FIG. 2 is an end view of the implement of FIG. 1.

Referring to the drawing, the present invention is directed to a tube cleaning implement 10 having an elongate axial shaft 12 comprising a wire twist of multiple strands 12*a*, preferably four, entwining stainless steel brush bristles B in a well-known manner. The bristles entwined in the twist wire shaft extend in a radial spiral pattern through a central section indicated by rectangle C of the shaft. The shaft at both ends extends beyond the central section defined by the brush and is fitted with scraper discs or wipers 14 at each end. The implement shown in FIG. 1 is symmetrical about its x-x' axis.

The wipers have identical construction and each comprises an integral plug body 14*a* of molded plastic with a cylindrical section 14*b* and a hemispherical nose 14*c* closing the wiper outer end. The hemispherical ends serve as a bumper protecting the bristle body.

An axial bore 14*d* in the plug body receives the shaft 12 in a friction fit capable on maintaining wiper/shaft assembly under normal operation conditions.

A plurality of wiper discs 14*e* normal to the implement axis x-x' and generally parallel to each other encircle the wiper body. Each of the circular wiper discs has a plurality, preferably four, of radial slots 14*f* for flexibility of the discs and to allow flow of propelling fluid and removed tube deposits to flow away from the implement. The nose 14*c* of the plug body includes notches 14*g* aligned with disc radial slots.

The implement performs a scrape-brush-scrape action on a tube wall as it is being propelled through the tube.

Multiple wipers on both ends pre-clean and post-clean a tube surface for the bristles. The wipers flat disc configuration render the implement reversible so that it may be inserted at either of its ends into a tube. Reversibility extends the implements useful life, especially useful life of the bristles.

Various changes may be made to the structure embodying the principles of the invention. The foregoing embodiments are set forth in an illustrative and not in a limiting sense. The scope of the invention is defined by the claims appended hereto.

I claim:

1. A tube cleaning implement comprising a supporting shaft defining a longitudinal axis, a set of tube cleaning bristles of predetermined diameter secured to a central section of the shaft, the shaft extending beyond each side of the central section and there defining shaft ends for receiving scrapers of similar construction on both sides of the central section, a scraper fitted to each end of the shaft, each scraper comprising a plug body having a cylindrical body section, a nose, an axial bore by which the scraper fits in covering relation to the end of the shaft, and a plurality of scraper discs of predetermined diameter, each disc being normal to the longitudinal axis, encircling the plug body and parallel to each other disc, the diameters of the bristles and the discs being selected to engage and clean the interior surface of a tube by performing a scrape-brush-scrape action, the implement being symmetrical about longitudinal axis to be reversible for insertion into a tube by either implement end thereby to extend useful life of the implement.

2. An implement as defined in claim 1 in which the shaft and bristles comprise stainless steel bristles entwined in a wire twist shaft.

3. An implement as defined in claim 1 in which the nose is hemispherical.

4. An implement as defined in claim 1 in which scraper discs have radial slots.

5. An implement as defined in claim 1 in which the axial bore is maintained on the shaft by friction fit.

* * * * *